United States Patent [19]

Lefebure

[11] 4,447,810

[45] May 8, 1984

[54] DOT AND DASH SEGMENT DISPLAY FOR SIMPLIFIED WRITING OF ARABIAN LANGUAGE

[75] Inventor: Jean M. Lefebure, Paris, France

[73] Assignee: Thomson-CSF, Paris, France

[21] Appl. No.: 321,705

[22] Filed: Nov. 16, 1981

[30] Foreign Application Priority Data

Dec. 2, 1980 [FR] France ..... 80 25558

[51] Int. Cl.[3] ..... G09G 3/00

[52] U.S. Cl. ..... 340/756; 340/790; 178/30

[58] Field of Search ..... 340/756, 722, 735, 762, 340/765, 790; 178/113, 30

[56] References Cited

U.S. PATENT DOCUMENTS

| | | | |
|---|---|---|---|
| 1,135,344 | 4/1915 | Ashley | 178/113 |
| 1,547,492 | 7/1925 | Belin | 178/113 |
| 4,237,459 | 12/1980 | Cordova | 340/756 |
| 4,271,497 | 6/1981 | Terzian | 340/756 |
| 4,283,723 | 8/1981 | Bickley et al. | 340/721 |

*Primary Examiner*—Marshall M. Curtis

*Attorney, Agent, or Firm*—Cushman, Darby & Cushman

[57] ABSTRACT

The light-emitting diode or liquid crystal display device, with a matrix structure, comprises a basic pattern repeated horizontally without spacing to form the matrix having three end-to-end vertical segments and four superimposed horizontal segments each having one end common with the end of at least one vertical segment, two dots disposed side by side in the upper third, and two dots disposed side by side in the lower third of the height of the pattern.

6 Claims, 7 Drawing Figures

DOT AND DASH SEGMENT DISPLAY FOR SIMPLIFIED WRITING OF ARABIAN LANGUAGE

BACKGROUND OF THE INVENTION

The invention relates to a segment and dot display device, particulary applicable to a simplified writing of the Arabian language, and to a visualization device comprising such a display device.

Devices for making visible stylized alphanumerical symbols by displaying straight line segments are known. The means for controlling these display devices comprise a limited number of all-or-nothing controls which allow all the symbols of a line of writing to be displayed simultaneously. These devices comprise light-emitting diodes or liquid crystals which are controlled electrically by two-state signals. These diodes or liquid crystals are arranged in matrices repeating a number of times a basic pattern comprising all the segments likely to be used to form these alphanumerical symbols. To display the characters, the simplest conventional display devices comprise matrices, formed by the repetition of a basic pattern having seven segments for digital display and fourteen segments for alphanumerical display, these repeated basic patterns being separated. Because the basic pattern is formed from straight line segments, the curvilinear appearance of conventional writing is not reproduced, but the graphism is comprehensible.

The conventional writing of the Arabian language is presented in the same way as conventional writing with Roman characters: the sentences are made up from words separated from each other, each word being a succession of letters of very different shapes joined together. These letters are composed of curves, straight line segments and isolated dots below or above the letters. These letters are sometimes only differentiated from each other by the presence or absence of these dots.

SUMMARY OF THE INVENTION

The invention provides a segment and dot display device, particularly applicable to writing of the Arabian language, comprising a matrix formed by the repetition of a simple basic pattern. All the stylized letters of the Arabian alphabet are inscribable in this matrix.

According to the invention, a dot and segment display device comprising a display matrix and a control device, is principally characterized in that the display matrix is formed by the repetition, on a line of writing and without spacing, of a basic pattern comprising at most seven straight line segments and four dots, these straight line segments being three end-to-end vertical segments and at most four superimposed horizontal straight line segments of the same length each having one end common with one end of a vertical segment, two dots being placed on a horizontal line in the upper third of the basic pattern thus defined and two other dots being placed on a horizontal line in the lower third of this same basic pattern, each of these elements, segment or dot, being controlled independently.

The invention also provides a visualization system comprising such a display device.

BRIEF DESCRIPTION OF THE DRAWINGS

The invention will be better understood and other characteristics will appear from the following description with reference to the accompanying figures.

The stylized characters displayable in a dot and segment matrix corresponding to the curvilinear Arabic characters must be such that they use a minimum of segments, horizontal segments and vertical segments, so that the structure of the resulting matrix is as simple as possible. However, all the characters must be able to be differentiated from each other and be able to be written as required in several ways. In fact, in Arabic writing, the letters are often written differently according as to whether they are placed at the beginning, in the middle or at the end of a word or whether they are isolated.

DESCRIPTION OF THE PREFERRED EMBODIMENT

Figure 1:
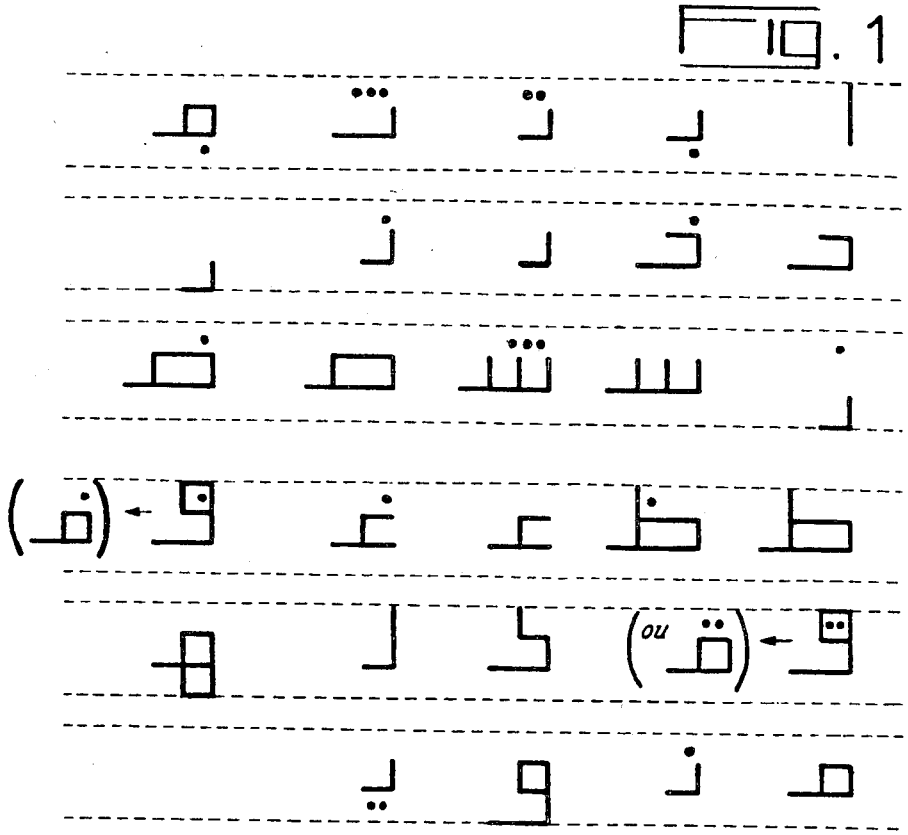
FIG. 1 shows one example of stylized letters of the Arabian alphabet for defining the display matrix.

FIG. 1 shows a succession of stylized Arabic characters, this stylized succession comprising writing simplifications used in Arabian countries and understood by their inhabitants. In this succession, a letter is represented by the same symbol, whatever its position in the word.

So as to be able to establish the basic pattern, the letters are stylized in vertical segments of a height equal to a third of the maximum height of a letter and in horizontal segments of the width of this pattern, having with the first segments common ends. In addition, the dots required for understanding the letters are placed in the upper third or in the lower third of the height used. Generally, these dots are placed with respect to the segments in the same way as in conventional writing except for two of these letters where the dots are within a square whereas, in conventional writing, they are above the loop symbolized by this square.

Such a figuration does not adversely affect understanding and allows a fairly simple basic pattern to be established, comprising eleven elements, seven segments and four dots, from which all the letters may be written without their form being substantially affected by this stylization.

Figure 2A:
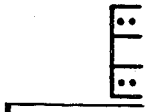
FIGS. 2*a* and 2*b* show the basic pattern and the display device of the invention, according to a first embodiment.
Figure 2B:
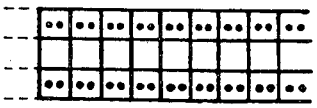

This first embodiment of the basic pattern and the corresponding matrix are shown in FIGS. 2*a* and 2*b*. This pattern shown in FIG. 2*a* comprises three end-to-end vertical segments and four superimposed horizontal segments having one end common with one end of at least one vertical segment. These segments separate therefore the space of the basic pattern into three squares. Two dots are placed side by side in the upper square and two other dots are placed side by side in the lower square.

The matrix shown in FIG. 2*b* is formed of a succession of these basic patterns joined side by side, without spacing therebetween.

Figure 3A:
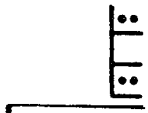
FIGS. 3*a* and 3*b* show the basic pattern and the display device of the invention, according to a second embodiment.
Figure 3B:
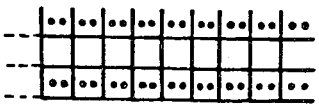

In a second embodiment, the stylization of the tall letters which comprise in addition dots above is provided in a different way. The simplification consists then in representing them with a reduced height, the dots being then suitably placed when, as previously, they are placed in the upper third of the height. The corresponding figuration is shown in brackets at the side of the first mode of figuration. This figuration leads to a simplification in the basic pattern with respect to the preceding one for letters which, in the first figuration mode, comprise a horizontal segment at the upper limit of the height of the space used and are represented differently. Consequently, this segment may be omitted in the basic pattern and each basic pattern then only requires ten controls instead of eleven. The basic pattern corresponding to this second figuration and the corresponding matrix are shown in FIGS. 3*a* and 3*c*, the matrix being constructed from the basic pattern as for the first embodiment.

With these two matrices all the Arabic words may be written.

Figure 4A:
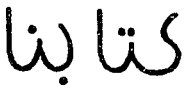
FIG. 4*a* shows one particular example of words written in Arabic characters and FIG. 4*b* shows the latter written in the display matrices of the invention.
Figure 4B:
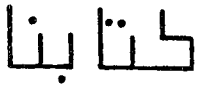

By way of example, FIG. 4*a* shows the writing in classical Arabic of the translation of "our book", FIG. 4*b* shows the same written in the display matrices described above.

As in the known segment display devices, the matrices may be formed for example with light-emitting diodes, with liquid crystals with electric control or even, for mechanically controlled display devices, with double face adapted to be turned over. The control devices associated with these different types of display matrices are known.

It should also be noted that figures are displayable in the same matrix provided that simplifications already known are used, and that these matrices may also be used for displaying characters of the Roman alphabet since these latter may be written simply from the straight line segments of these matrices.

The invention is not limited to the figuration of letters, in the embodiments of the display device just described, in accordance with the table of FIG. 1. In particular, the different letters may be elongated and stylized over more basic patterns than has been shown in this figure and may be modified, providing that the modifications introduced can be inscribed in one or other of the two embodiments of matrices described and that there is no ambiguity in the writing of these letters.

It is also possible, in these matrices, to write the letters in a different way depending on the position that they occupy in the words, and in particular to represent the final letters in a different way from the same letter at the beginning of the word so as to approximate as much as possible the stylized writing to conventional writing.

Finally, modifications of detail may be introduced without departing from the scope of the invention.

The field of application of this device is very wide since it extends, for visualizing information in clear in the Arabian language, to supports as different as liquid crystal display watches with an alphanumeric dial, display panels, terminal consoles in data transmission systems or mechanical display panels. The readability of the characters remains very good even for characters of very small dimensions (of the order of 2 to 3 millimeters).

What is claimed is:

1. A dot and dash segment display device for arabic characters with a display matrix formed by the repetition, on a line of writing and without spacing, of a basic pattern, said device comprising a plurality of display elements forming a series of vertical line segments, at least three horizontal line segments with one horizontal segment contacting one end of the vertical segments and at least two horizontal segments dividing the vertical segments into upper, lower and central portions and areas and two dots in each upper and lower area.

2. The device as claimed in claim 1, wherein the basic pattern comprises seven straight line segments, four of which are horizontal.

3. The device as claimed claim 1, wherein said segments and dots are formed by light-emitting diodes.

4. The device as claimed in claim 1, wherein said luminous segments and dots are formed by liquid crystals placed between control electrodes.

5. A display as in claim 1 wherein said matrix is formed with four superimposed horizontal line segments.

6. A display device as in claim 1 wherein said elements form a fourth horizontal segment contacting the other end of the vertical segments.

* * * * *